US005117733A

United States Patent [19]

Fischer et al.

[11] Patent Number: 5,117,733

[45] Date of Patent: Jun. 2, 1992

[54] APPARATUS FOR SETTING THE TIME FUSE OF A PROJECTILE

[75] Inventors: Rainer Fischer, Frankfurt; Kurt Rast, Kälberau, both of Fed. Rep. of Germany

[73] Assignee: Honeywell Regelsysteme GmbH, Offenbach, Fed. Rep. of Germany

[21] Appl. No.: 660,672

[22] Filed: Mar. 15, 1991

[51] Int. Cl.[5] ..... F42C 17/04

[52] U.S. Cl. ..... 89/6.5

[58] Field of Search ..... 89/6.5, 6

[56] References Cited

U.S. PATENT DOCUMENTS

| | | | |
|---|---|---|---|
| 1,917,814 | 7/1933 | Rühlemann | 89/6.5 |
| 2,555,384 | 6/1951 | Watt | 89/6.5 |
| 2,603,970 | 7/1952 | Metzler | 89/6.5 |
| 4,022,102 | 5/1977 | Ettel | 89/6.5 |
| 4,080,869 | 3/1978 | Kanayannis et al. | 89/6.5 |
| 4,649,796 | 3/1987 | Schmidt | 89/6.5 |
| 4,730,794 | 3/1988 | Knauer | 89/6.5 |

FOREIGN PATENT DOCUMENTS

| | | | |
|---|---|---|---|
| 2042695 | 9/1980 | United Kingdom | 89/6 |

*Primary Examiner*—David H. Brown

*Attorney, Agent, or Firm*—George A. Leone, Sr.

[57] ABSTRACT

An apparatus for setting the time fuse of a projectile comprising a receiving coil arranged on the axis of the projectile and a transmitting coil device with said coil device comprising ferrite elements extending parallel to the axis of the projectile over a circular-shaped feeding segment. The ferrite elements are enclosed by a flat-strip winding with said flat-strip winding extending substantially parallel to the feeding path of the projectile.

9 Claims, 3 Drawing Sheets

APPARATUS FOR SETTING THE TIME FUSE OF A PROJECTILE

The present invention relates to an apparatus for the energizing and setting of the time fuse of a projectile and more particularly to a magnetic field sensor based breech fusing mechanism.

BACKGROUND OF THE INVENTION

It is known in the art to inductively transmit the running time information of a weapon by means of a stationary transmitting coil to the receiving coil of a projectile. Problems arise when this information has to be transmitted with sufficient power during the duration of the movement of the projectile. The transmitting time is limited to the time duration in which the receiving coil is crossing the magnetic field of the transmitting coil.

SUMMARY OF THE INVENTION

The present invention provides ferrite bars enclosed by a coil winding extending parallel to a projectile axis. A receiving coil is arranged on the projectile axis so that the magnetic flux density for the receiving coil over the feeding path parallel to the coil device is independent from the axial position of the projectile.

It is, therefore, a primary object of the present invention to devise an apparatus for the setting of the time fuse of a projectile during the feeding of the projectile to a weapon which apparatus allows the generation of a magnetic field for the receiving coil with said magnetic field over a portion of the feeding path intersecting the receiving coil regardless of the axial position of the receiving coil.

It is one object of the invention to provide a magnetic coupling within a weapon housing that is nearly constant throughout the total feeding path of the weapon. An auxiliary coil is arranged in the vent of the breech and proximate to a main coil on the same ferrite core device. When not in a programming mode the main coil is traversed by a current. The voltage change within the auxiliary coil at the entrance of the projectile into the magnetic field may be used to trigger the programming sequence.

Other objects, features and advantages of the present invention will become apparent to those skilled in the art through the Description of the Preferred Embodiment, Claims, and drawings herein wherein like numerals refer to like elements.

BRIEF DESCRIPTION OF THE DRAWINGS

To illustrate the invention, a preferred embodiment of this invention will be described hereinafter with reference to the accompanying drawings.

DESCRIPTION OF THE PREFERRED EMBODIMENT

Figure 1:
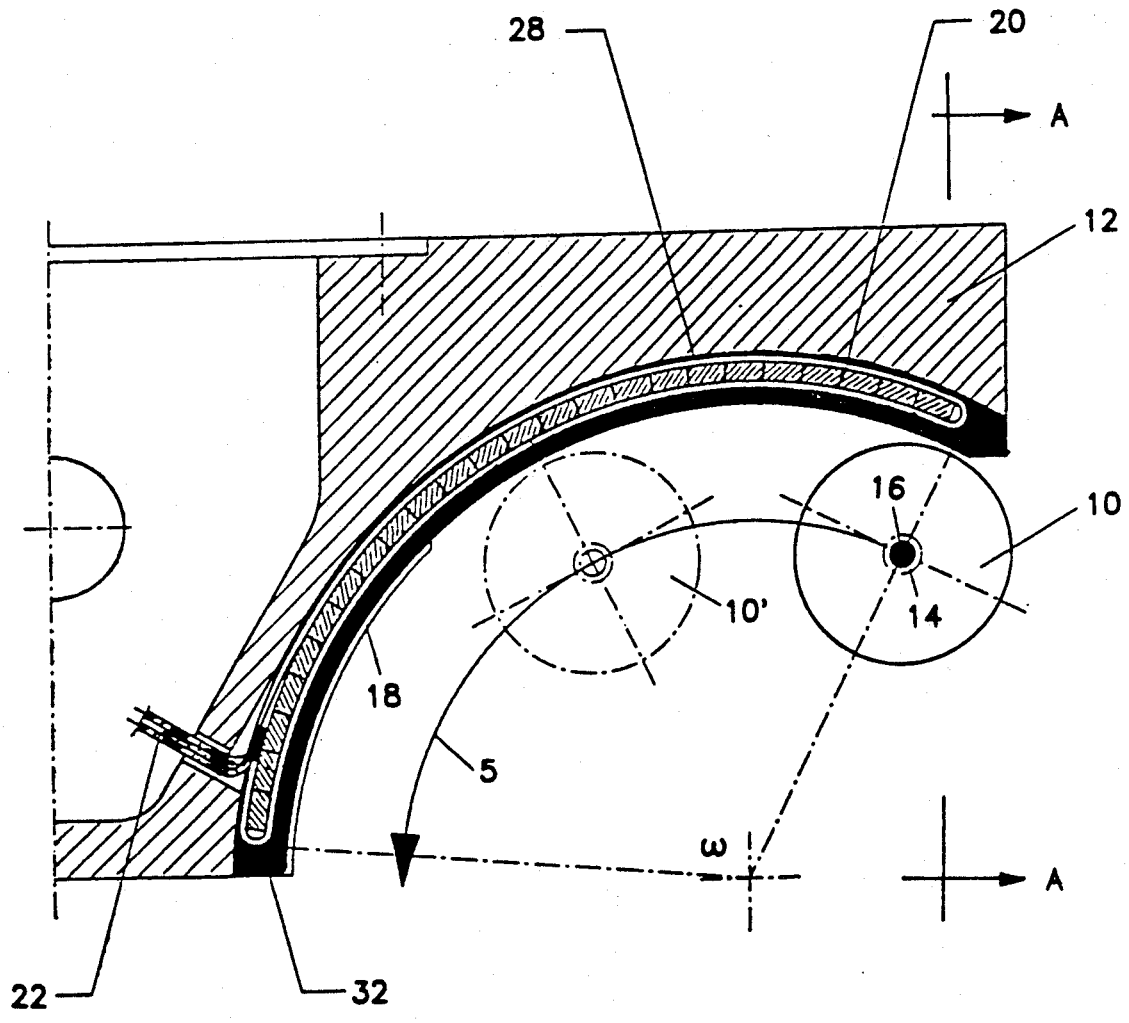
FIG. 1 indicates a cross section through a portion of the weapon housing comprising a coil device.
Figure 2:
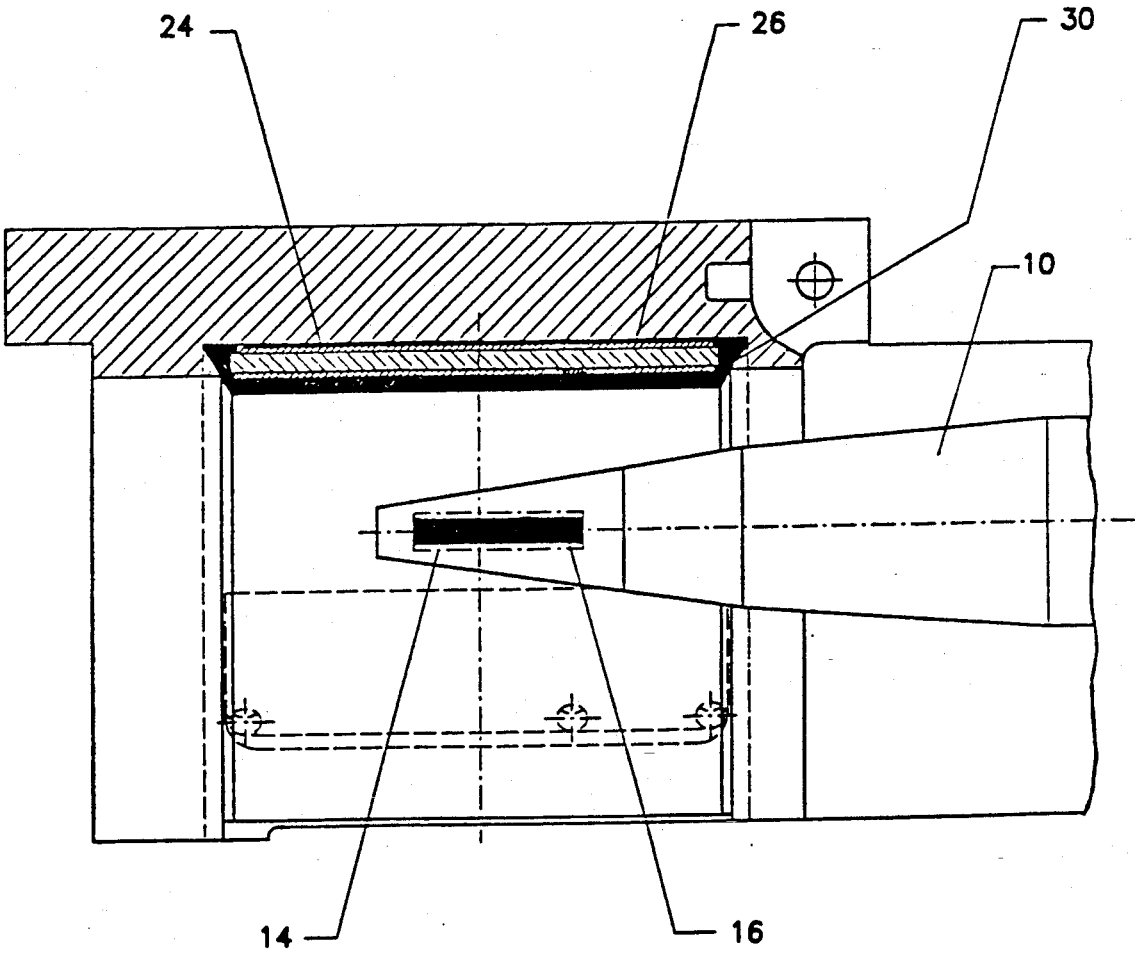
FIG. 2 shows a view along line A—A in FIG. 1.

According to FIGS. 1 and 2, projectiles 10, 10' are fed along the shown arrow 5 to the breech mechanism of a weapon by means of a not-shown cam device. A portion 12 of the weapon housing 12 is shown in FIG.

1. The projectiles 10.10' are guided by means of the cam device and the weapon housing 12 over a portion of a circular arc with said arc extending approximately over an arc of 120° as indicated by angle $\omega$. Within each projectile 10 a receiving coil 14 is arranged on a core 16. Core 16 is bar-shaped and extends along the projectile axis. In order to input running time information into the receiving coil 14 as the projectile 10 travels over the circular arc $\omega$, a coil device 18 is arranged within the weapon housing 12 which also extends substantially over said circular arc $\omega$.

The coil device 18 comprises ferrite elements 20 having a rectangular cross section and being arranged side by side on said circular arc and extending parallel to the axis of the projectile 10. The ferrite elements 20 are enclosed by a side by side arrangement of staggered flat-strip windings 22, shown in detail in FIG. 3. The coil device 18 consists of a main coil 24 and an auxiliary coil 26 both enclosing the ferrite elements 20 and being matched to the outline of the arcuate-shaped feeding path. The ferrite elements 20 as well as the main coil 24 and the auxiliary coil 26 are insulated by an insulating film 28 between the weapon housing 12 and the coil device 18. The film is molded within a dovetail-shaped groove 30 of the weapon housing 12 by means of a sealing compound 32.

Figure 3A:
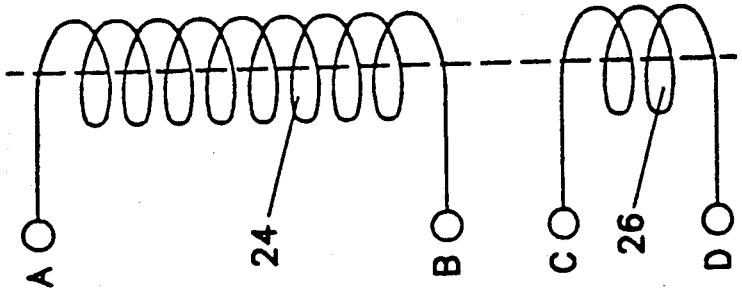
FIG. 3 shows the used coil device in its structural design as well as a corresponding electrical equivalent circuit diagram.
Figure 3:
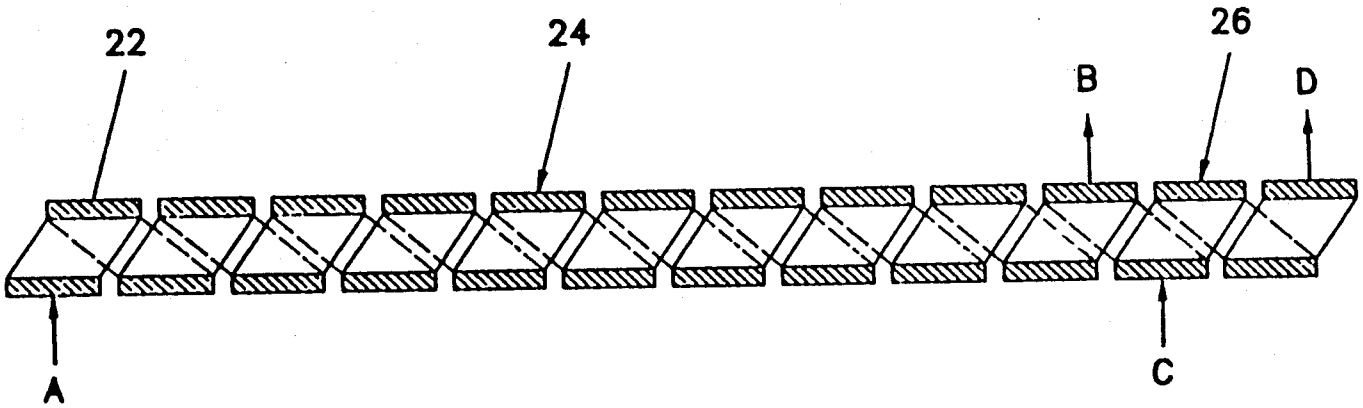

In the apparatus of the invention, the main coil 24 is fed with a current at its terminals A, B shown in FIG. 3A. In the time period some time outside of the programming sequence time a voltage pulse is induced in the auxiliary coil 26 when the projectile 10 is fed into the arcuate-shaped feeding segment. This voltage pulse may be outputted at the terminals C, D in FIG. 3 and may be used for triggering the programming sequence within the main coil 24.

Those skilled in the art will appreciate that at the coil device 18 the magnetic field crossing the receiving coil 14 and the core 16 is nearly independent of the axial position of the projectile 10 so that the magnetic field coupling is nearly constant over the total feeding path.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. An apparatus for setting the time fuse of a projectile, which projectile has an axis and is fed along a feeding path in a breech, comprising:

(a) a receiving coil extending along the axis of said projectile;

(b) a coil device extending parallel to a portion of the feeding path, the coil device comprising a side by side arrangement of ferrite elements enclosed by a winding which is substantially parallel to the feeding path.

2. The apparatus of claim 1 wherein the projectile feeding path extends over a portion of a circular arc so that the coil device forms a portion of a tube shape.

3. The apparatus of claim 2 wherein the breech includes a housing having a dovetail shaped groove and wherein the coil device is inserted and casted into the dovetail shaped groove.

4. The apparatus of claim 1 wherein the winding comprises a flat-strip material which encloses the ferrite elements in a staggered, side by side arrangement.

5. The apparatus of claim 4 wherein the projectile feeding path extends over a portion of a circular arc so that the coil device forms a portion of a tube shape.

6. The apparatus of claim 5 wherein the breech includes a housing having a dovetail shaped groove and wherein the coil device is inserted and casted into the dovetail shaped groove.

7. The apparatus of claim 4 wherein the coil device comprises a main coil and an auxiliary coil wherein the main coil is permanently traversed by a current and a voltage change within the auxiliary coil effected by the feeding of the projectile into the breech serves to trigger a programming sequence within the main coil.

8. The apparatus of claim 7 wherein the projectile feeding path extends over a portion of a circular arc so that the coil device forms a portion of a tube shape.

9. The apparatus of claim 8 wherein the breech includes a housing having a dovetail shaped groove and wherein the coil device is inserted and casted into the dovetail shaped groove.

* * * * *